US007247807B2

(12) United States Patent
Gutierrez et al.

(10) Patent No.: US 7,247,807 B2
(45) Date of Patent: Jul. 24, 2007

(54) BUTTON HAVING STIFFER VERTICAL MOTION AND REDUCED LATERAL MOTION

(75) Inventors: Joseph A. Gutierrez, Thornton, CO (US); William R. Haas, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 267 days.

(21) Appl. No.: 10/614,141

(22) Filed: Jul. 7, 2003

(65) Prior Publication Data

US 2005/0017832 A1 Jan. 27, 2005

(51) Int. Cl.
*H01H 13/00* (2006.01)
*H01H 3/00* (2006.01)

(52) U.S. Cl. ..... 200/329; 200/345; 200/344

(58) Field of Classification Search ..... 200/329, 200/18, 5 A, 341–345
See application file for complete search history.

(56) References Cited

U.S. PATENT DOCUMENTS 4,582,967 A * 4/1986 Brumit et al. ..... 200/5 A
5,003,133 A * 3/1991 Kobayashi et al. ..... 200/5 A
5,051,550 A * 9/1991 Harris ..... 200/330
5,131,308 A * 7/1992 Katsuta ..... 84/434
5,193,667 A * 3/1993 Choi ..... 200/331
5,481,074 A * 1/1996 English ..... 200/5 A
5,569,889 A * 10/1996 Bruner ..... 200/5 A
5,817,997 A * 10/1998 Wernig ..... 200/16 R
6,051,768 A * 4/2000 Masubuchi ..... 84/433
6,051,799 A * 4/2000 Fuhrmann ..... 200/331
6,384,355 B1 * 5/2002 Murphy et al. ..... 200/344
6,392,179 B1 * 5/2002 Schwarzbich ..... 200/520
6,492,605 B2 * 12/2002 Iida ..... 200/343
6,570,111 B2 * 5/2003 Nakagawa et al. ..... 200/343
6,846,999 B2 * 1/2005 Kawakami et al. ..... 200/341
2001/0047927 A1 12/2001 Ogawa et al.

FOREIGN PATENT DOCUMENTS

JP 4315715 A 11/1992
JP 8055539 A 2/1996
JP 9097534 A 4/1997
JP 9251822 A 9/1997

OTHER PUBLICATIONS

Foreign Search Report issued for GB 0 41 4953.0, dated Dec. 3, 2004.

* cited by examiner

*Primary Examiner*—K. Lee

(57) ABSTRACT

One embodiment of the invention is a button for engaging an electrical switch comprising: a button post that transmits a vertical motion of the button to the electrical switch, an alignment post that registers against the electrical switch and reduces lateral motion of the button, and at least two runners that connect the button to a frame and includes reinforcement that stiffens the vertical motion of the button.

13 Claims, 2 Drawing Sheets

BUTTON HAVING STIFFER VERTICAL MOTION AND REDUCED LATERAL MOTION

FIELD OF THE INVENTION

The invention relates in general to buttons, and in specific to a button that has a stiffer vertical motion and reduced lateral motion.

BACKGROUND OF THE INVENTION

A button set is an interface between a user and an electrical switch. For example, a user would push a desired button of the button set, which would then engage the electric switch. FIG. 1 depicts a prior art example of a button set 10 which comprises a plurality of buttons 11. FIG. 1 depicts a bottom view of the button set 10. In other words, the portion that the user would push is underneath button 11 and is not shown. Each button includes two runners 14 that connect the button 11 to the header or frame 15. Each button also includes a button post 12 that engages an electric switch (not shown) and a stop post 13 that stops the downward movement of the button 11. The button 11 moves until the stop post 13 engages the surface of the PC Board on which the switch is mounted (not shown). This prevents damage to the button and/or the electric switch.

The button set 10 of FIG. 1 typically has a 'cheap' feel. The button set has too much registration (clearance or slop) that the user has to move the button through until the electric switch is engaged. This may occur when the user contacts a portion of the button that is not co-linear with the button post. Thus, the bottom demonstrates a lot of unproductive movement—movement that is not depressing the electrical switch. Some of this unproductive movement is lateral, instead of vertical. This lateral movement may cause misalignment of the button post 12 and the electric switch, such that activation may not occur or activation may require more button travel. Moreover, the buttons typically have 'dead spots', or portions that when pushed or depressed, do not activate the electric switch. These factors diminish the value of the product and contribute to the cheap button feel.

BRIEF SUMMARY OF THE INVENTION

One embodiment of the invention is a button for engaging an electrical switch comprising: a button post that transmits a vertical motion of the button to the electrical switch, an alignment post that registers against the electrical switch and reduces lateral motion of the button, and at least one runner that connects the button to a frame and includes reinforcement that stiffens the vertical motion of the button.

DETAILED DESCRIPTION OF THE INVENTION

Embodiments of the invention preferably comprise a reinforcement member that is located on the runners which stiffens the button movement. This causes the button to move uniformly when depressed, and prevents the button from rocking if the button is depressed on a side away from the center of the button. Embodiments of the invention further comprise an alignment post that registers against an electric switch. This reduces lateral movement of the button when the button is depressed, and reduces or eliminates dead spots on the button.

Figure 1:
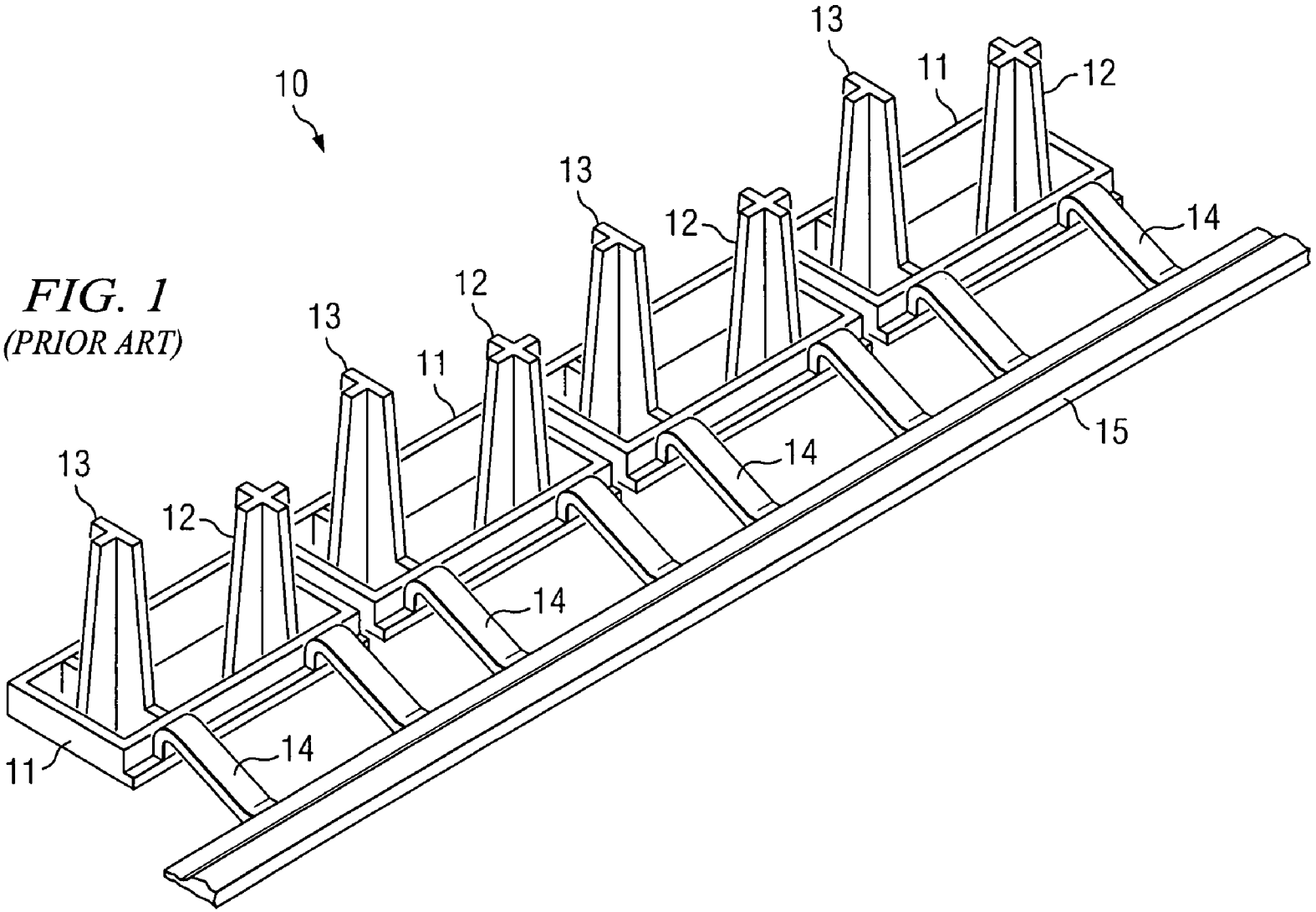
FIG. 1 (PRIOR ART)
FIG. 1 depicts a prior art example of a button set which comprises a plurality of buttons.
Figure 2:
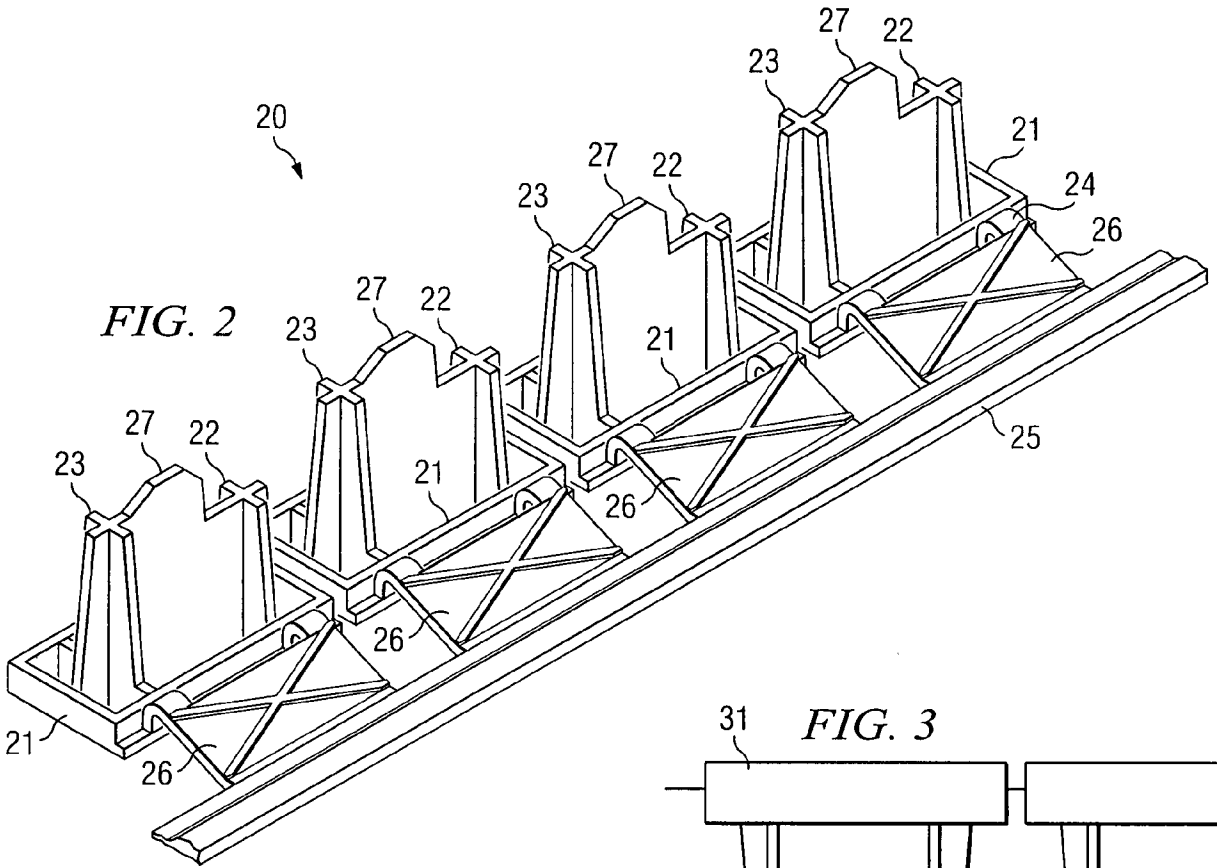
FIG. 2 depicts an example of an embodiment of the invention.

FIG. 2 depicts an example of an embodiment of the invention. Button set 20 comprises a plurality of buttons 21. FIG. 2 depicts a bottom view of the button set 20. In other words, the portion that the user would push is underneath button 21 and is not shown. Each button preferably includes two runners 24 that connect the button 21 to the header or frame 25. Each button also preferably includes button post 22 that engages an electric switch (not shown). Each button also preferably includes stop post 23 that stops the downward movement of the button 21. The button 21 would move until the stop post 23 engages another surface, e.g. the PC Board. This prevents damage to the button and/or the electric switch.

Button set 20 also preferably comprises a reinforcement member 26 for each button 21, that is located on the runners which stiffens the button movement. The reinforcement member 26 causes the button to move uniformly when depressed. This prevents the button from wobbling or rocking, i.e., one side moving down and the other side moving up or not moving down, if the button is depressed on a side away from the center of the button. The reinforcement member acts to distribute the downward motion from the depression of the button to both runners. Thus, no matter where (or how) the button is depressed, the button moves uniformly.

Note that FIG. 2 depicts two runners being connected to the button, however more runners may be used. The reinforcement member would distribute the downward motion to each of the runners. In FIG. 2 the reinforcement member is shown as a rectangular panel having two structural ribs located on the diagonals of the panel. However, this is by way of example only, as other types of reinforcement members could be used. For example, the reinforcement may comprise two ridges arranged in a plus sign (+), connecting the midpoints of the sides of a rectangular panel. It is preferable to have the reinforcement member molded along with the runners. However, the reinforcement member may be attached (e.g. glued or welded) to the runners.

Button set 20 also preferably comprises an alignment post for each button and electrical switch 32. The alignment post 27 registers against the electric switch that is engaged by the button 21 or 31. The alignment post 27 reduces lateral movement of the button when the button 21 or 31 is depressed, and reduces or eliminates dead spots on the button. Reducing the lateral movement of the button reduces the slop in the button.

Figure 3:
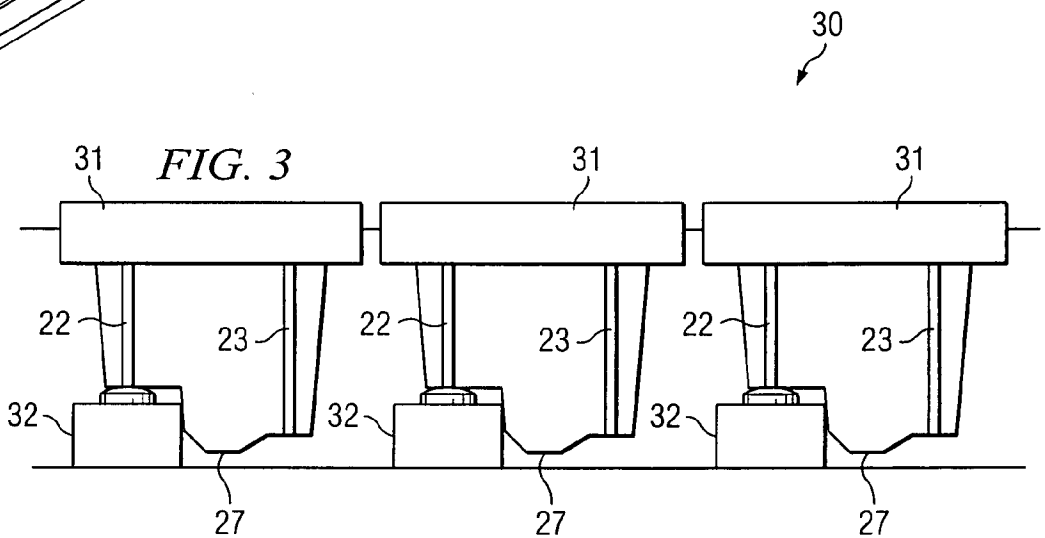
FIG. 3 is another view of the example of FIG. 2.

FIG. 3 depicts another view 30 of the button set 20 of FIG. 2. In this view, the alignment post 27 is registering against a side of the electric switch 32. Upon depressing button 31, the button post 22 would engage the electric switch 32.

Note that it is preferable to have the embodiments of the invention include both the alignment post and the reinforced runner(s) to prevent or reduce the 'cheap feel' of the button set.

The button set may reside on an electronic device, e.g. a scanner, a camera, a printer, a copier, a facsimile machine, a computer, or any other electronic device.

Note that the embodiments of the invention has been described in terms of a button set that comprises a plurality of buttons. However, embodiments of the invention will operate with a single button. Further note that embodiment of the invention contemplate that one or more of the alignment post, the runners and the reinforcement are formed from plastic, however other materials may be used, e.g. a metal.

What is claimed is:

1. A button, comprising:

a button post to transmit a vertical motion of the button to a first side of an electrical switch;

an alignment post to register against a second side of the electrical switch; and at least two runners to connect the button to a frame.

2. The button of claim 1, wherein the button is included in a button set that comprises a plurality of buttons.

3. The button of claim 1, further comprising a reinforcement to stiffen the vertical motion of the button, with the reinforcement comprising:

a rectangular panel having two supporting ribs located on diagonals of the panel.

4. The button of claim 3, wherein the reinforcement is molded along with the two runners.

5. The button of claim 1, wherein the alignment post and the two runners are formed from plastic.

6. The button of claim 1, wherein the button is located on an electronic device.

7. The button of claim 6, wherein the electronic device is selected from the group consisting of:

a scanner, a camera, a printer, a copier, a facsimile machine, and a computer.

8. A button set that comprises a plurality of buttons, each button of the plurality of buttons configured to engage an associated electrical switch of a plurality of electrical switches, the button set comprising:

a plurality of button posts, each of which is associated with a respective button and configured to transmit a vertical motion of the respective button to a first side of the associated electrical switch;

a plurality of alignment posts, each of which is associated with a respective button and configured to register against a second side of the associated electrical switch; and a plurality of runners, with a pair of runners of the plurality of runners associated with a respective button and configured to connect the respective button to a frame.

9. The button set of claim 8, wherein each pair of the runners includes a reinforcement comprising:

a rectangular panel having two ridges located on diagonals of the panel.

10. The button set of claim 9, wherein the reinforcement is molded along with the runners.

11. The button set of claim 8, wherein the plurality of alignment posts and the plurality of runners are formed from plastic.

12. The button set of claim 8, wherein the button set is located on an electronic device.

13. The button set of claim 12, wherein the electronic device is selected from the group consisting of:

a scanner, a camera, a printer, a copier, a facsimile machine, and a computer.

* * * * *